US007713384B2

(12) United States Patent
Bartelmuss et al.

(10) Patent No.: US 7,713,384 B2
(45) Date of Patent: May 11, 2010

(54) DEVICE FOR DETACHABLY FIXING A HOLDER FOR A DOCTOR BLADE IN A PAPER PRODUCTION PLANT

(76) Inventors: Klaus Bartelmuss, Nr. 63, Teufenbach (AT) A-8833; Heinz Bartelmuss, Nr. 63, Teufenbach (AT) A-8833

( * ) Notice: Subject to any disclaimer, the term of this patent is extended or adjusted under 35 U.S.C. 154(b) by 559 days.

(21) Appl. No.: 11/657,372

(22) Filed: Jan. 24, 2007

(65) Prior Publication Data

US 2007/0187057 A1 Aug. 16, 2007

(30) Foreign Application Priority Data

Feb. 16, 2006 (AT) ..... A 247/2006

(51) Int. Cl.
*D21G 3/00* (2006.01)
*D21G 3/04* (2006.01)

(52) U.S. Cl. ..... 162/281; 15/256.51; 118/413; 248/221.11; 248/274.1

(58) Field of Classification Search ..... 162/272, 162/280–281; 15/256.5, 256.51; 118/413; 100/174; 248/221.11, 220.42, 309.1, 309.4, 248/200, 274.1, 298.1; 399/343, 350–351
See application file for complete search history.

(56) References Cited

U.S. PATENT DOCUMENTS 3,778,861 A * 12/1973 Goodnow ..... 15/256.51
3,803,665 A * 4/1974 Winterburn et al. ..... 15/256.51
4,367,120 A * 1/1983 Hendrikz ..... 162/281
4,665,859 A * 5/1987 Dunlap et al. ..... 118/126
4,906,335 A * 3/1990 Goodnow et al. ..... 162/281
5,108,794 A * 4/1992 Kinnunen ..... 427/356
6,328,853 B1 * 12/2001 Goodnow et al. ..... 162/281
6,458,247 B1 * 10/2002 Uuttana ..... 162/281
6,786,999 B2 * 9/2004 Goodnow et al. ..... 162/281
7,108,766 B1 * 9/2006 Eskelinen et al. ..... 162/263
7,399,382 B2 * 7/2008 Bartelmuss et al. ..... 162/272
2002/0153115 A1 * 10/2002 Goodnow et al. ..... 162/281
2003/0161956 A1 * 8/2003 Makinen et al. ..... 427/355
2005/0076464 A1 * 4/2005 Bartelmuss et al. ..... 15/256.51

(Continued)

FOREIGN PATENT DOCUMENTS

AT 502824 A4 * 6/2007

(Continued)

*Primary Examiner*—José A Fortuna
(74) *Attorney, Agent, or Firm*—Laurence A. Greenberg; Werner H. Stemer; Ralph E. Locher

(57) ABSTRACT

A device for the detachable fixing of a holder for a doctor blade located in a paper production plant, it being possible for the doctor blade, which is assigned to a supporting or guiding roll for the wire, for the felt or for the paper web, to be set in its position with respect to the supporting or guiding roll by way of an actuating device and, furthermore, it being possible for the holder for the doctor blade to be displaced on a support for the holder by way of a guide at least approximately in the axial direction of the supporting or guiding roll and fixed on the support in the operating position. A pressure hose is disposed between the holder for the doctor blade and the support. The pressure hose allows the holder for the doctor blade to be clamped to the support.

6 Claims, 2 Drawing Sheets

U.S. PATENT DOCUMENTS

2007/0144377 A1* 6/2007 Henninger et al. ..... 101/363
2007/0187057 A1* 8/2007 Bartelmuss et al. ..... 162/281
2008/0121770 A1* 5/2008 Bartelmuss et al. .... 248/221.11
2009/0101028 A1* 4/2009 Melotti ..... 101/169
2009/0148208 A1* 6/2009 Gauvin et al. ..... 399/351
2009/0266256 A1* 10/2009 Rothlein et al. ..... 101/366

FOREIGN PATENT DOCUMENTS

EP 1045067 A1 * 10/2000
GB 2071723 A * 9/1981
JP 2007217856 A * 8/2007

* cited by examiner

DEVICE FOR DETACHABLY FIXING A HOLDER FOR A DOCTOR BLADE IN A PAPER PRODUCTION PLANT

CROSS-REFERENCE TO RELATED APPLICATION

This application claims the priority, under 35 U.S.C. §119, of Austrian application A 247/2006, filed Feb. 16, 2006; the prior application is herewith incorporated by reference in its entirety.

BACKGROUND OF THE INVENTION

Field of the Invention

The present invention relates to a device for the detachable mounting of a holder for a doctor blade located in a paper production plant. It is thereby possible for the doctor blade, which is assigned to a supporting or guiding roll located in the plant for the wire, for the felt or for the paper web, to be set in its position with respect to the supporting or guiding roll by means of an actuating device. It is furthermore possible for the holder for the doctor blade to be displaced on a support for the holder by means of a guide at least approximately in the axial direction of the supporting or guiding roll and fixed on the support in the operating position.

In paper production plants, there is a wire which is moved over supporting or guiding rolls along the plant and to which the paper pulp or paper stock is applied. In the direction of movement of the wire, the liquid contained in the paper stock is extracted from the latter and the paper web produced in this way is dried as air is aspirated through the wire. Further along in this plant there is a felt, on which the paper web is dried further. Both the wire and the felt are moved over supporting and guiding rolls. Further along, the paper web is moved directly over the supporting and guiding rolls.

Because of the liquid extracted from the paper stock and because of the drying operations, constituent parts, in particular pulp fibers, carried away out of the paper stock or the paper web reach the supporting or guiding rolls, by which fibers the supporting or guiding rolls are contaminated. Since the function of the supporting or guiding rolls is impaired by these contaminants, there is the need to subject these to continuous cleaning. For this purpose, the supporting and guiding rolls are each assigned a doctor blade which is brought into contact with the relevant supporting and guiding roll, by which means contaminants located on this roll are doctored off the same.

In this case, there is the need to arrange the doctor blade in such a way that it bears on the relevant roll with a predefined pressure. For this purpose, the holder for the doctor blade is constructed with a device for adjusting the angular position of the doctor blade with respect to the relevant roll. Furthermore, the holder for the doctor blade, which is located on a support for this holder, must be fixed detachably to this holder. Since the holder for the doctor blade with the device for setting the angular position of the doctor blade often has to be replaced in order to be able to clean these components, there is also the need to form a fixing of the holder for the doctor blade on the support for the holder in such a way that it can be produced or detached in the simplest possible way.

From the prior art, it is known to form the holder for the doctor blade and the support for this holder with guide strips that are assigned to each other, to which there is assigned a fixing screw, the guide strips being clamped to each other by the fixing screw.

SUMMARY OF THE INVENTION

The present invention is based on the object of providing a clamping means which can be actuated substantially more simply, likewise effective clamping being achieved.

With the above and other objects in view there is provided, in accordance with the invention, a device for detachably fixing a holder for a doctor blade in a paper production plant, wherein the doctor blade is operatively associated with a supporting or guiding roll for a wire, for a felt, or for a paper web in the paper production plant. The assembly comprises:

an actuating device for setting a position of the doctor blade relative to the supporting or guiding roll;

a holder for holding the doctor blade, said holder being displaceably mounted on a support for said holder by way of a guide at least substantially in an axial direction of the supporting or guiding roll and fixable on said support in an operating position of the doctor blade; and a pressure hose disposed between said holder for the doctor blade and said support and configured to clamp said holder for the doctor blade to said support.

In other words, the objects of the invention are achieved in that between the holder for the doctor blade and the support for the holder there is provided a pressure hose, by means of which the holder for the doctor blade can be clamped to the support for the holder.

The holder and the support are preferably formed with strips that are assigned to each other and extend in the axial direction of the supporting and guiding roll and project obliquely away from the holder and from the support, as a result of which they can be clamped to each other by inflating the pressure hose. In this case, the holder for the doctor blade and the support for the holder can be formed as plates oriented approximately parallel to one other, which are formed with guide strips running in the axial direction that are assigned to each other and project obliquely away from the plates, and the pressure hose, which is arranged between the two plates, can be located between the two pairs of guide strips oriented to one another and oriented parallel to the latter.

As soon as a cleaned holder with a doctor strip has been pushed into the operating position in the axial direction of the rolls by means of the guide strips, the pressure hose is inflated, by which means the holder for the doctor blade is clamped to the support for the holder. As soon as the holder with a doctor blade is to be removed, the pressure existing in the pressure hose is lowered, as a result of which the holder can be displaced with respect to the support and subsequently detached from the latter. A cleaned holder with a doctor blade can then be pushed into the support and clamped to the latter by the pressure hose.

Other features which are considered as characteristic for the invention are set forth in the appended claims.

Although the invention is illustrated and described herein as embodied in device for detachably fixing a holder for a doctor blade located in a paper production plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
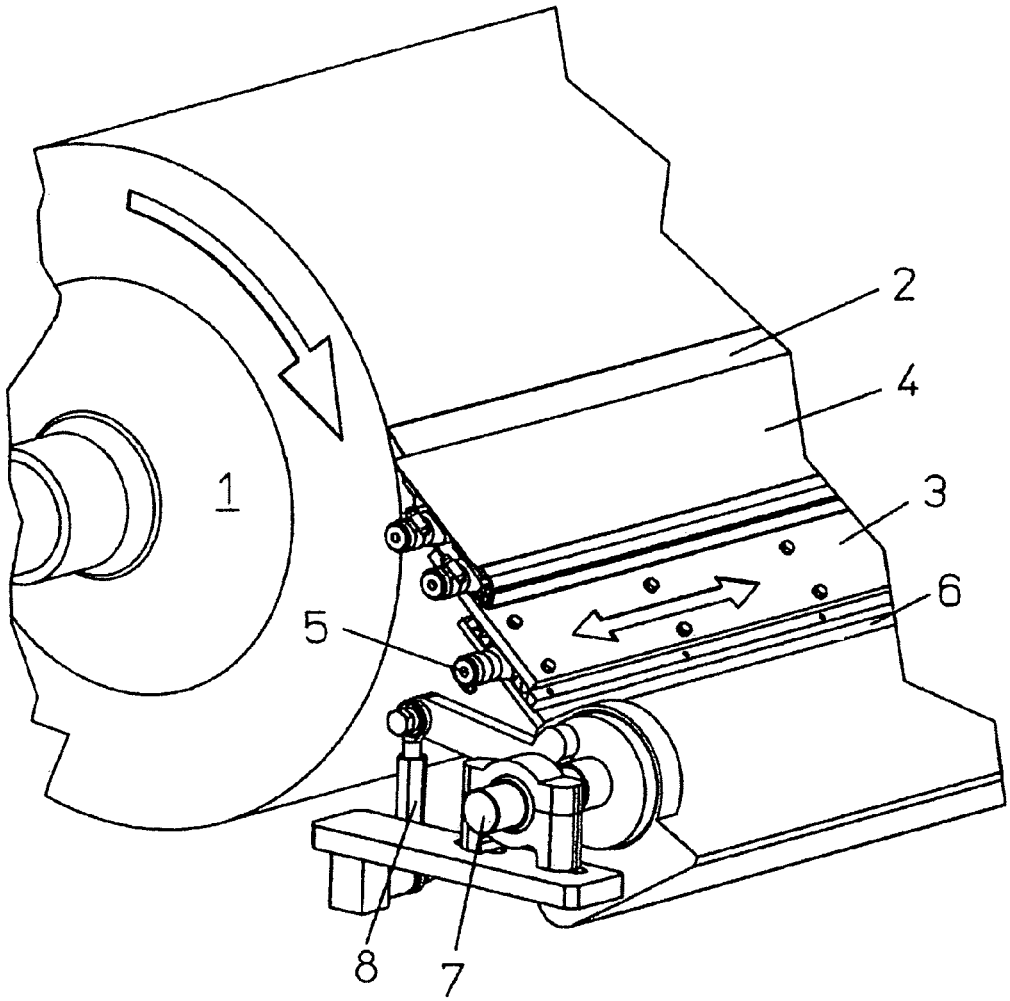
FIG. 1 is a partial, axonometric view of a supporting or guiding roll with a doctor blade assigned to the latter which is fixed to a holder, the holder being fixed to a support.

Referring now to the figures of the drawing in detail and first, particularly, to FIG. 1 thereof, there is shown a supporting and guiding roll 1, which is located in a paper production plant underneath the wire, the felt or the paper web. The roll 1 is assigned a doctor blade 2, which can be brought into contact with the surface of the roll 1, being oriented in the direction opposite to the direction of rotation of the roll 1. By way of the doctor blade 2, contaminants on the surface of the roll 1 which are caused by the dewatering of the paper stock on the wire or by the drying of the paper web, are removed.

The doctor blade 2 is fixed to a holder 3 for the doctor blade 2. The holder 3 is formed with an actuating device 4 which is used to be able to set the angular position of the doctor blade 2 with respect to the holder 3 and with respect to the surface of the roll 1. The holder 3 for the doctor blade 2 is fixed detachably to a support 6 for the holder 3. Between the holder 3 and the support 6 there is also a device 5, by means of which the holder 3 can be fixed to the support 6 in a straightforward manner and detached from the latter. The support 6 is fixed to a shaft 7, which extends in the axial direction of the roll 1 and which can be set into a pivoted position by means of a rod strainer 8 and can be fixed in said position.

Figure 2:
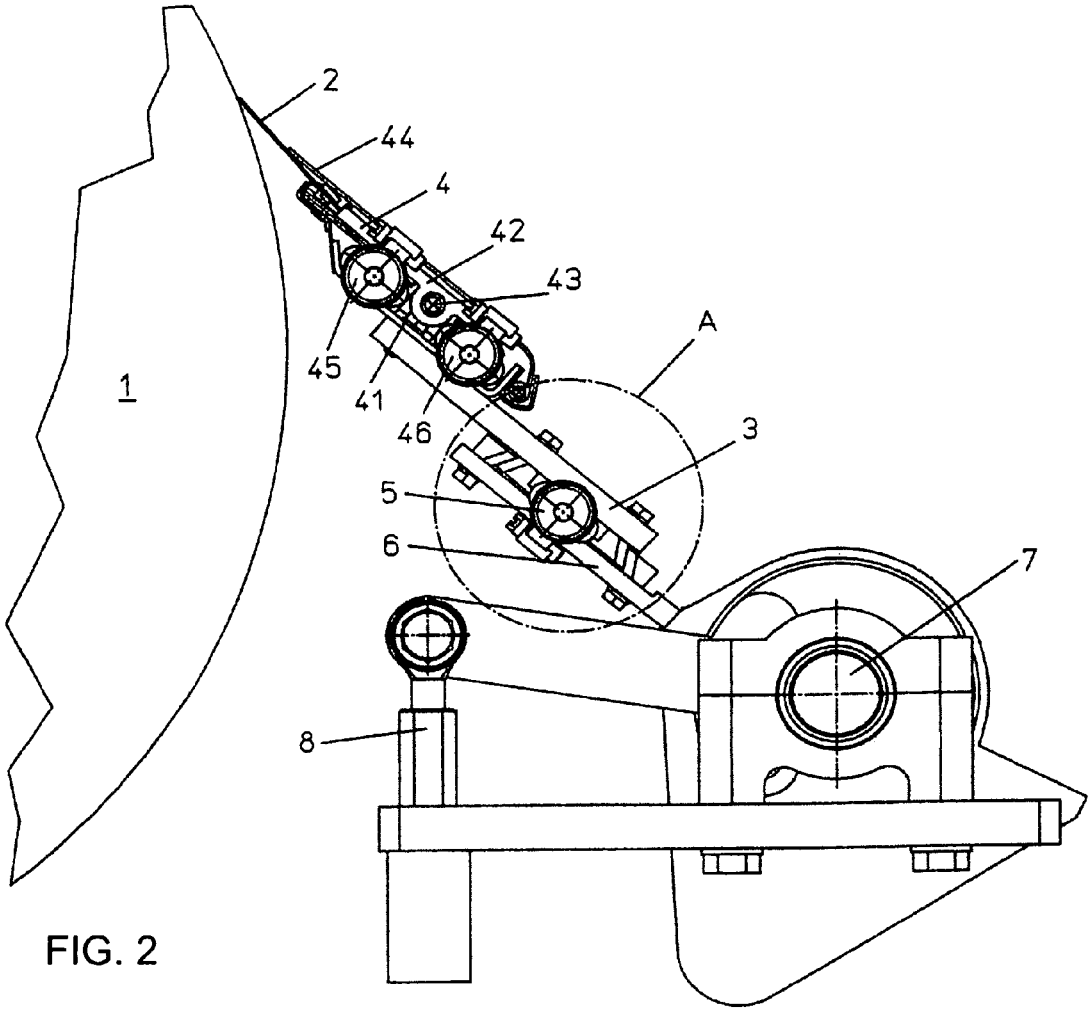
FIG. 2 is an end view of the components illustrated in FIG. 1.

Referring now to FIG. 2, the actuating device 4 comprises a housing which has a lower housing part 41 and an upper housing part 42. The upper housing part 42 is mounted by way of a joint 43 such that it can pivot on the lower housing part 41. Furthermore, the free end 44 of the upper housing part 42 bears on the upper side of the doctor blade 2. Within the housing parts 41 and 42 there are two inflatable hoses 45 and 46 which are arranged at a distance from each other and oriented in the axial direction of the roll 1 and by means of which the upper housing part 42 can be pivoted with respect to the lower housing part 41 in such a way that the doctor blade 2 bears on the surface of the roll 1 with an adjustable pressure.

Figure 2A:
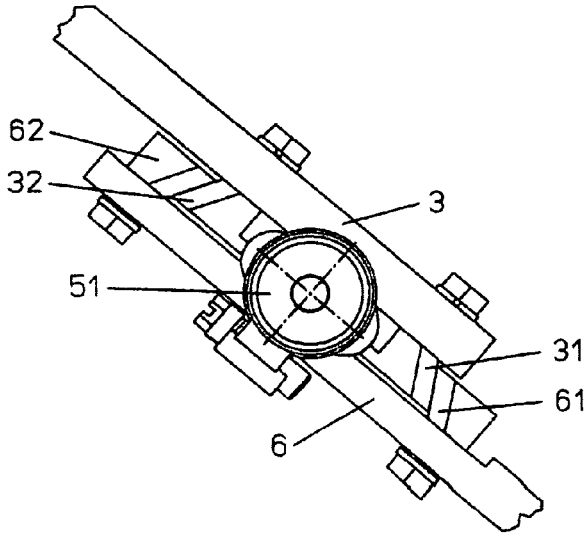
FIG. 2A is an enlarged view of the detail A in FIG. 2.

With reference to FIG. 2A, the holder 3 for the doctor blade 2 is formed with two strips 31 and 32 which project obliquely downward and are oriented in the axial direction of the roll 1, which are assigned strips 61 and 62 located on the support 6 and project obliquely upward. These pairs of strips 31, 32 and 61, 62 form guides, by means of which the holder 3 can be displaced with respect to the support 6 in the axial direction of the roll 1, as indicated in FIG. 1 by a double arrow. In this way, the holder 3 with the doctor blade 2 can be pulled off the support 6 for the holder 3 in order to be cleaned, and a cleaned holder 3 with a doctor blade 2 can be pushed onto the support 6.

The device 5 for fixing the holder 3 for the doctor blade 2 to the support 6 is formed by a pressure hose 51 which is located between the holder 3 and the support 6 and between the strips 31, 61 and 32, 62 assigned to one another. As soon as the pressure hose 51 is inflated, the holder 3 is lifted off the support 6 and the strips 31, 61 and 32, 62 projecting obliquely from the latter are wedged in one another, by which means the holder 3 is clamped to the support 6. As soon as the pressure in the pressure hose 51 is reduced, this clamping is canceled, which means that the holder 3 can be displaced with respect to the support 6 and detached from the latter.

In this way, a means of fixing the holder 3 for a doctor blade 2 to the support 6 for the holder 3 is produced which can be actuated very simply and, despite this, is very effective, which means that the holder 3 with the doctor blade 2 can be removed from the support 6 in a straight-forward way and replaced by a clean holder 3.

We claim:

1. A device for detachably fixing a holder for a doctor blade in a paper production plant, wherein the doctor blade is operatively associated with a supporting or guiding roil for a wire, for a felt, or for a paper web in the paper production plant, comprising:

an actuating device for setting a position of the doctor blade relative to the supporting or guiding roll;

a holder for holding said actuating device and the doctor blade, said holder being displaceably mounted on a support for said holder by way of a guide at least substantially in an axial direction of the supporting or guiding roil and fixable on said support in an operating position of the doctor blade;

a pressure hose disposed between said holder for the doctor blade and said support and configured to damp said holder for the doctor blade to said support.

2. The device according to claim 1, wherein said holder and said support are formed with stripe assigned to each other and extending in the axial direction of the supporting and guiding roll and projecting obliquely away from said holder and from said support, whereby said stripe can be damped to each other by inflating the pressure hose.

3. The device according to claim 1, wherein said holder for the doctor blade and said support for said holder are formed as plates oriented approximately parallel to one another, said plates are formed with guide stripe extending in the axial direction and projecting obliquely away from said plates, and wherein said pressure hose is disposed between said two plates and between two pairs of mutually assigned guide strips and oriented parallel thereto.

4. The device according to claim 1, wherein said actuating device comprises a housing with a lower housing part and an upper housing part pivotally mounted on said lower housing part, and at least one pressure hose disposed to selectively pivot said upper housing part relative to said lower housing part and to thereby adjust a position of the doctor blade.

5. A device for detachably fixing a holder for a doctor blade in a paper production plant, wherein the doctor blade is operatively associated with a supporting or guiding roll for a wire, for a felt, or for a paper web in the paper production plant, comprising:

a support;

a holder displaceably mounted to said support by way of a guide at least substantially in an axial direction of the supporting or guiding roll and fixable on said support in an operating position wherein the doctor blade is operatively associated with the supporting or guiding roll;

an actuating device for setting a position of the doctor blade relative to the supporting or guiding roll, said actuating device carrying and holding the doctor blade;

a pressure hose disposed between said holder and said support and configured to clamp said holder to said support.

6. The device according to claim 5, wherein said actuating device comprises at least one pressure hose disposed to selectively adjust a position of the doctor blade by pivoting the doctor blade relative to said holder.

* * * * *